US008051514B2

(12) United States Patent
Yarmer et al.

(10) Patent No.: US 8,051,514 B2
(45) Date of Patent: Nov. 8, 2011

(54) PILLOW HAVING A CONCEALED FOOD SURFACE WITH INTEGRAL BEVERAGE HOLDER

(76) Inventors: Daniel A. Yarmer, Colorado Springs, CO (US); Jay Brock Matthews, Colorado Springs, CO (US); Lawrence M. Pelletier, Colorado Springs, CO (US)

( * ) Notice: Subject to any disclaimer, the term of this patent is extended or adjusted under 35 U.S.C. 154(b) by 0 days.

(21) Appl. No.: 12/284,719

(22) Filed: Sep. 24, 2008

(65) Prior Publication Data

US 2009/0235458 A1 Sep. 24, 2009

Related U.S. Application Data

(60) Provisional application No. 60/995,018, filed on Sep. 24, 2007.

(51) Int. Cl.
*A47C 20/00* (2006.01)

(52) U.S. Cl. ..... 5/639; 108/43; 220/17.1

(58) Field of Classification Search ..... 5/507.1, 5/630, 635, 636, 639, 640, 643, 645, 657, 5/694; 220/17.1, 906; 248/311.2, 346.01; 108/43

See application file for complete search history.

(56) References Cited

U.S. PATENT DOCUMENTS 1,851,600 A * 3/1932 Stanley ..... 108/43
4,928,336 A 5/1990 Petillo
5,076,405 A * 12/1991 Modica ..... 190/1
5,081,936 A * 1/1992 Drieling ..... 108/43
5,460,102 A * 10/1995 Pasmanick ..... 108/43
D366,780 S 2/1996 Brooks
5,678,266 A * 10/1997 Petringa et al. ..... 5/655.5
5,732,849 A * 3/1998 Brooks ..... 220/603
5,915,561 A 6/1999 Lorenzana
6,050,200 A * 4/2000 Sullins et al. ..... 108/43
6,216,297 B1 4/2001 Lemke
D509,695 S 9/2005 Cuttino
6,941,601 B2 9/2005 DeBartolo
7,334,838 B2 * 2/2008 Pope ..... 297/188.14
7,461,421 B1 * 12/2008 Faircloth et al. ..... 5/639
2002/0029832 A1 * 3/2002 Carlson ..... 150/110

* cited by examiner

*Primary Examiner* — Robert G Santos
*Assistant Examiner* — Nicholas Polito
(74) *Attorney, Agent, or Firm* — Gordon Silver; Ronald C. Gorsché

(57) ABSTRACT

The invention generally pertains to a pillow convertible between an open position as a food and beverage holder and a closed position as a pillow. By way of example, the pillow has a first and second pillow portion that may be coupled and uncoupled to switch between a closed position and an open position. The pillow also has a food surface member with one or more beverage holders that is sized to fit within the interior of the pillow in the closed position. In another example, the food surface member is a two-piece construction with a slidable tray lock that moves between a first position when the pillow is closed and a second position that secures the two pieces together as a substantially coplanar surface when the pillow is open. In yet another example, the beverage holder is tapered so as to fit a variety of sizes of beverage containers.

23 Claims, 16 Drawing Sheets

PILLOW HAVING A CONCEALED FOOD SURFACE WITH INTEGRAL BEVERAGE HOLDER

CROSS-REFERENCE TO RELATED APPLICATION

This application claims priority to, under 35 U.S.C. §119 (e), and is a non-provisional application of U.S. provisional patent application No. 60/995,018, filed Sep. 24, 2007, entitled "Concealed Beverage Holder Pillow with Adjacent Placemat," the disclosure of which is hereby incorporated by reference in its entirety.

FIELD OF THE INVENTION

This invention relates, in general, to pillows, and more particularly to a convertible pillow having a concealed food surface with integral beverage holder.

BACKGROUND OF THE INVENTION

For many folks, relaxing on sectional couches with ottomans, couches and reclining chairs is a daily activity. Relaxation is often accompanied by the enjoyment of a beverage, snack or meal. Couches and reclining chairs, however, do not typically provide a place to securely place a beverage and/or snack that is easily accessible from a multitude of locations or positions on the furniture. For example, end tables or a coffee table positioned along side a sectional couch with an ottoman may be difficult to access and, in many cases, are non-functional for the intended purpose if one is positioned too far away from the access point. Moreover, many households do not even use a coffee table in their living rooms because of the significant amount of space they consume. Thus, households are left with a limited capability for providing a convenient, user friendly, and secure location to place beverage and snacks while lounging on, for example, sectionals with ottomans, couches or reclining chairs. Thus, current furniture arrangements may create an inconvenience for something that should be simple and practical—the ability to comfortably enjoy a drink and snack while making use of the comforts of a piece of furniture.

Each year, millions of pillows are sold across America for decorating and providing comfort for ones head while lying down. Pillows are typically incorporated into living room designs for many purposes, such as, enhancing the appearance of the room by complimenting the design of the furniture. Since they are readily available and can easily blend in with the décor of a room without being an eye sore, it is desirable to incorporate a food surface with integral beverage holder into a pillow that can effortlessly switch between the functions of a comfortable pillow and a food/beverage holder. It is against this background that various embodiments of the present invention were developed.

SUMMARY

The invention pertains generally to a method and apparatus for a convertible pillow that swaps between a pillow and a food/beverage holder. More particularly, the invention pertains to a pillow that has a pillow member and a food surface member. The pillow member has a first and second pillow portion in its preferred embodiment, but a single pillow member with a single pillow portion is contemplated and is not outside the spirit and scope of the present invention. The food surface member typically has at least one integral beverage holder and is sized to fit within the convertible pillow in the closed position as a pillow. The components and compositions of the present invention may be embodied in multiple ways and forms for achieving a pillow that switches between a food/beverage holder and a pillow. Accordingly, different embodiments exist for the physical make-up of the convertible pillow.

In one embodiment, a convertible pillow is disclosed having a closed position as a pillow and an open position as a food surface and beverage holder. The convertible pillow comprises a pillow member having a first pillow portion and a second pillow portion. An edge of the first pillow portion is coupled to an edge of the second pillow portion such that the first and second pillow portions are separable on at least three sides in the open position. The first pillow portion is also configured to be hinged and foldable relative to the second pillow portion at the connected edges so as to convert between the closed position and the open position. The convertible pillow also has a food surface member having at least one integral beverage holder. The food surface member is appropriately sized to fit within the convertible pillow in the closed position. The integral beverage holder is configured to securely receive different sizes of beverage containers.

In one aspect of the invention, the food surface member comprises a two-piece food surface member having a first surface portion and a second surface portion. The first surface portion is removably secured to the first pillow portion and the second surface portion is removably secured to the second pillow portion using at least one food surface member holding means.

According to another broad aspect of one embodiment of the present invention, the first food surface member and said second food surface member are removably secured together by at least one slidable locking member. Typically, the slidable locking member moves within a slidable locking member groove. The groove is located on the surface and positioned adjacent an edge of the first and second food surface members.

In another embodiment, a convertible pillow is disclosed having a pillow member, two-piece food surface and slidable tray lock. The pillow member has a first pillow portion and a second pillow portion. The first pillow portion is configured to be coupled to the second pillow portion in a closed position. The first pillow portion is also configured to be uncoupled from the second pillow portion along at least three pillow portion edges in an open position. The two-piece food surface has a first surface portion and a second surface portion and is configured to fit within the interior of the pillow member in the closed position. The first and second surface portions each have a tapered beverage holder located within an opening in the surface portions. In addition, the first and second surface portions each have a first slidable tray lock groove positioned adjacent an edge of the surface portions. The first slidable tray lock is configured to move between a first position and a second position within the first slidable tray lock grooves. The first position allows the first and second pillow portions to be coupled in the closed position. The second position allows the first and second surface portions to be secured together as a substantially flat coplanar surface when the first and second pillow portions are uncoupled in the open position.

The foregoing and other features, utilities and advantages of the invention will be apparent from the following more particular description of various embodiments of the invention as illustrated in the accompanying drawings and claims.

DETAILED DESCRIPTION

In the following description, numerous specific details are set forth, such as examples of specific shapes, components etc., in order to provide a thorough understanding of the present invention. It will be apparent, however, to one skilled in the art that the present invention may be practiced without these specific details. In other instances, well known components or methods have not been described in detail but rather in general terms in order to avoid unnecessarily obscuring the present invention. Thus, the specific details set forth are merely exemplary. The specific details may be varied from and still be contemplated to be within the spirit and scope of the present invention.

Reference to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
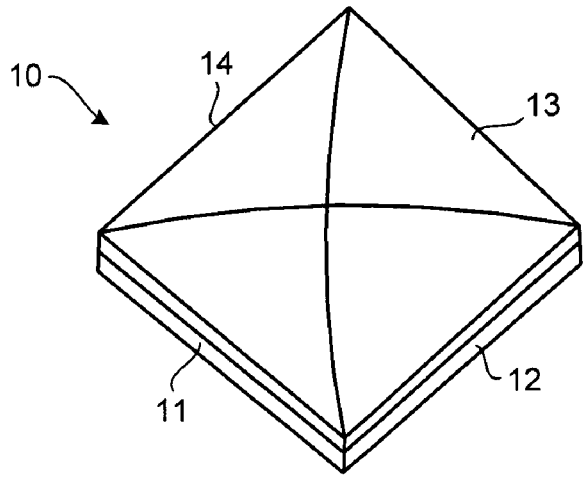
FIG. 1 illustrates a top perspective view of one embodiment of a convertible pillow having a concealed beverage holder and accompanying food surface.

FIG. 1 is a top perspective view illustrating one embodiment of a convertible pillow 10 having a concealed food surface with an integral beverage holder. The embodiment of the pillow 10 is illustrated in the closed position so that it may be used as a pillow. The components of the convertible pillow 10 that together form the concealed food surface with integral beverage holder are found within the interior of the pillow 10 and are typically not visible when the pillow is in the closed position. Convertible pillow 10 is illustrated as being approximately square in shape with pillow edges 11, 12, 13, 14, however, one of ordinary skill in the art will understand that pillow 10 may be of any shape or size, such as round or rectangular, and still come within the scope and spirit of the present invention.

Figure 2:
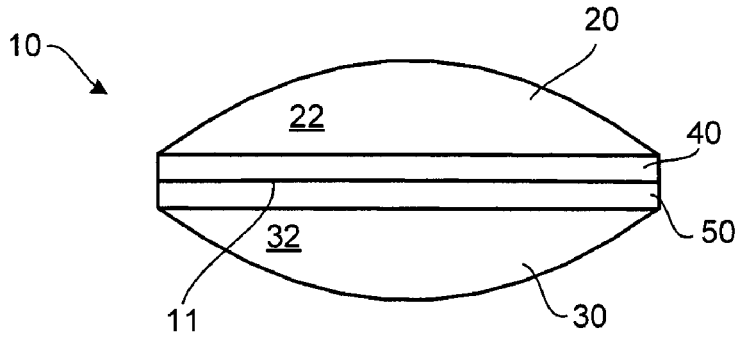
FIG. 2 illustrates a side view of the convertible pillow embodiment of FIG. 1.

FIG. 2 is a side view of the embodiment of the convertible pillow 10 of FIG. 1 looking directly at pillow edge 11. The side view shown in FIG. 2 is substantially similar to the views facing directly at pillow edge 12, pillow edge 13, or pillow edge 14. Convertible pillow 10 comprises a first pillow portion 20 and a second pillow portion 30. In one particular embodiment, first pillow portion 20 has a first connecting edge 40 that is configured to be removably coupled with the second connecting edge 50 of the second pillow portion 30. First pillow portion 20 and second pillow portion 30 are constructed of typical pillow material such as memory foam, down, synthetic, neoprene or the like. First pillow portion 20 is covered with covering 22 and second pillow portion 30 is covered with covering 32. Coverings 22, 32 are manufactured of any material suitable for use as a pillow cover. In addition, coverings 22, 32 may be permanently secured to the surface of the pillow portions 20, 30 or removable so that the design of the pillow may be changed to match the décor of the room.

In the closed position of pillow 10, for pillow edge 11, the first connecting edge 40 of the first pillow portion 20 contacts the second connecting edge 50 of the second pillow portion 30. For each of the remaining pillow edges 12, 13, 14 of pillow 10, each connecting edge of the first pillow portion 20 contacts the corresponding connecting edge of the second pillow portion 30. First pillow portion 20 is typically held in contact with second pillow portion 30 by a pillow securing means (not shown) such as a zipper, clasp or similar device.

Figure 3:
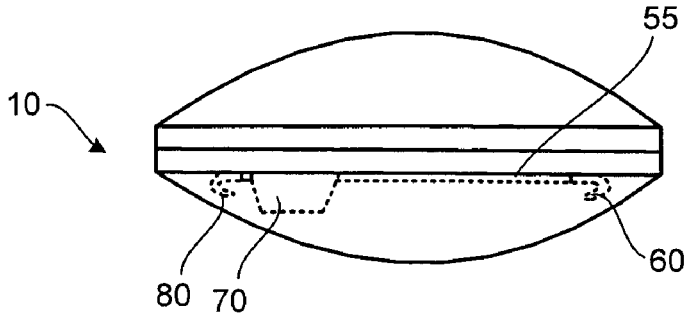
FIG. 3 illustrates a side view of the embodiment of the convertible pillow of FIG. 2 having a translucent second portion to illustrate the food surface, food surface securing hooks and drink holder.

FIG. 3 illustrates the same side view of the embodiment of the convertible pillow 10 of FIG. 2 with the second pillow portion 30 translucent to illustrate the placement of certain components within the interior of the pillow. The food surface 55 is shown in the illustrated embodiment as secured to the second pillow portion 30 using a plurality of food surface member holding means 60, 80. In the illustrated embodiment, the plurality of food surface member holding means 60, 80 are shown as hooks. Typically, the material of the second pillow portion 30 provides a connecting member (not shown) for receiving the hook so as to securely fasten the food surface 55 to the second pillow portion 30. The beverage or cup holder 70 is also shown in the illustrated embodiment as residing within the material of the second pillow portion 30. As shown, in the closed position, the food surface 55 with the integral beverage holder 70 is located entirely within the interior of pillow 10.

Figure 4:
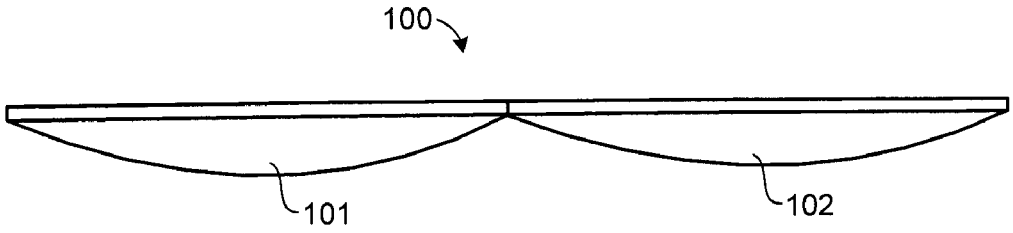
FIG. 4 illustrates a side view of one embodiment of a convertible pillow having a first pillow portion and a second pillow portion in the open position.

FIG. 4 illustrates a side view of a convertible pillow 100 in an open position as a food surface and beverage holder. Convertible pillow 100 is comprised of a first pillow portion 101 and a second pillow portion 102. In the illustrated embodiment, a connecting edge of the first pillow portion is coupled to a connecting edge of the second pillow portion to form a hinge member 103 such that first pillow portion 101 is foldable relative to second pillow portion 102. Hinge member 103, which may be just the coupling of the two connecting edges of the first and second pillow portions 101, 102, provides a pivot point for the pillow 100 to convert between a closed position illustrated and described with respect to FIGS. 1-3 and an open position illustrated and described with respect to FIGS. 4-6.

Figure 5:
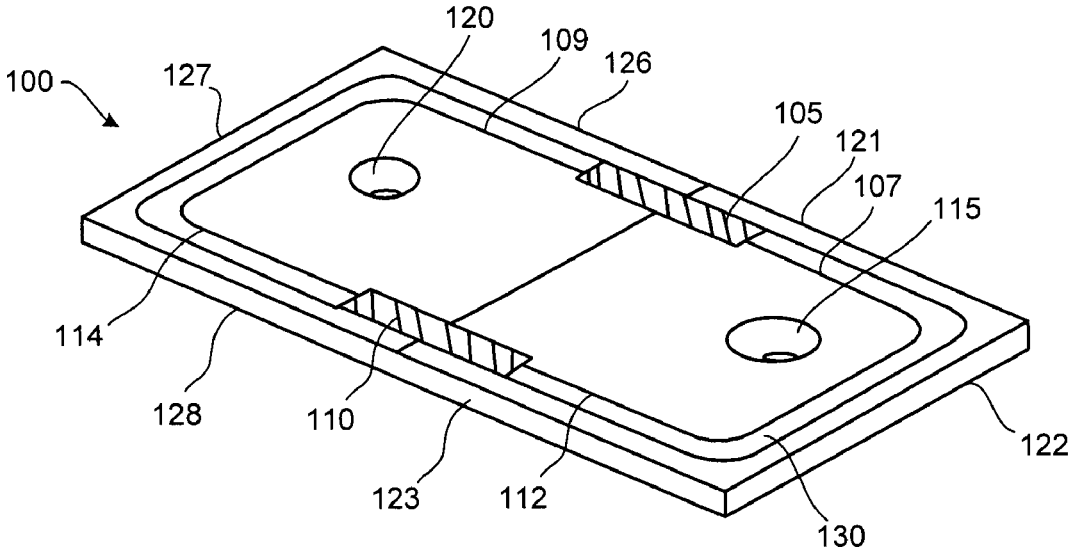
FIG. 5 illustrates a top perspective view of the embodiment of the convertible pillow of FIG. 4 having a two-piece food surface with multiple drink holders, the first surface portion and the second surface portion removably secured together as a single surface using a plurality of slidable surface locking members.

Convertible pillow 100 is illustrated in the open position from a top perspective view in FIG. 5. First pillow portion 101 has a plurality of connecting edges 126, 127, 128 and second pillow portion is comprised of a plurality of connecting edges 121, 122, 123. In the closed position (not shown) each of the connecting edges of the first and second pillow portions are coupled together. In the illustrated example, in the closed position, connecting edge 121 is coupled to connecting edge 126, connecting edge 122 is coupled to connecting edge 127 and connecting edge 123 is coupled to connecting edge 128. The top perspective view of pillow 100 reveals a food surface member interior to the pillow that is entirely hidden from view in the closed position.

In the illustrated embodiment, the food surface is a two-piece design comprised of a first surface portion 120 and a second surface portion 125. The first and second surface portions 120, 125 may be manufactured of any material suitable for use as a surface for supporting food articles and the like. In addition, the first and second surface portions 120, 125 may be textured to create a non-skid textured surface such that food items do not easily slip off the surface. First surface portion 120 is removably coupled to first pillow portion 101 and second surface portion 125 is removably coupled to second pillow portion 102. An integral beverage holder 120 is located within an opening in the first surface portion 120. Typically, the beverage holder 120 is tapered from the maximum diameter of the opening in the first surface portion to a smaller diameter within the interior of the holder such that the beverage holder is able to securely hold a number of sizes of beverage containers such as a drinking glass, beer mug, coffee cup, fast food cup, travel mug or the like. The tapered shape of the beverage holder 120 (more clearly shown in FIG. 8) snuggly holds the beverage container within the interior of the space to keep the beverage container from spilling and emptying the contents onto an undesirable location, such as a person's lap or the furniture. If some liquid does escape, the pillow 100 provides a liquid spill groove 130 to capture any spillage. In the illustrated embodiment, an integral beverage holder 115 is also located within an opening in the second surface portion 125. It should be appreciated that a single or multiple beverage holders may be located within openings of the first and second surface portions 120, 125 without departing from the intended scope of the invention.

In the illustrated embodiment, in open position, the first surface portion 120 and the second surface portion 125 are removably secured together by a first slidable locking member 105 and a second slidable locking member 110. Although, it should be readily understood by one of skill in the art that a single slidable locking member may also be used to achieve the desired result. The first surface portion 120 has a plurality of locking member grooves 109, 114 and the second surface portion also has a plurality of locking member grooves 107, 112 located on at least the surface shown in FIG. 5. A plurality of locking member grooves, however, may also be found on the opposite side of the first and second surface portions (not shown). In the illustrated embodiment, locking member groove 109 is shown adjacent to connecting edge 126 of first pillow portion 101, locking member groove 114 is shown adjacent to connecting edge 128 of first pillow portion 101, locking member groove 112 is shown adjacent to connecting edge 123 of second pillow portion 102 and locking member groove 107 is shown adjacent to connecting edge 121 of second pillow portion 102. The locking member grooves 107, 109, 112, 114 are configured to receive the first and second slidable locking members 105, 110 and allow the slidable locking member to freely slide along the grooves.

In operation, first slidable locking member 105 moves between a first position and a second position within the locking member grooves 107, 109 and second slidable locking member 110 moves between a first position and a second position within the locking member grooves 112, 114. In the first position, for example, first slidable locking member 105 would move either to the left or the right such that it rests entirely on either the locking member groove 107 or the locking member groove 109. Similarly, in the first position of the illustrated example, second slidable locking member 110 would also move to the left or to the right so that it rests entirely on either the locking member groove 112 or the locking member groove 114. Thus, the first position is configured to allow the first pillow portion 101 and the second pillow portion 102 to be coupled in a closed position.

In the second position, for example, first slidable locking member 105 would move either to the left or the right such that it rests on both the locking member groove 107 and the locking member groove 109 at the coupling 103 of the two connecting edges of the first and second pillow portions 101, 102. Similarly, in the first position of the illustrated example, second slidable locking member 110 would also move to the left or to the right so that it rests on both the locking member groove 112 and the locking member groove 114 at the coupling 103 of the two connecting edges of the first and second pillow portions 101, 102. Thus, the second position is configured to allow the first surface portion 120 and the second surface portion 125 to be secured together as a substantially flat coplanar surface when the first and second pillow portions 101, 102 are uncoupled in an open position.

Figure 6:
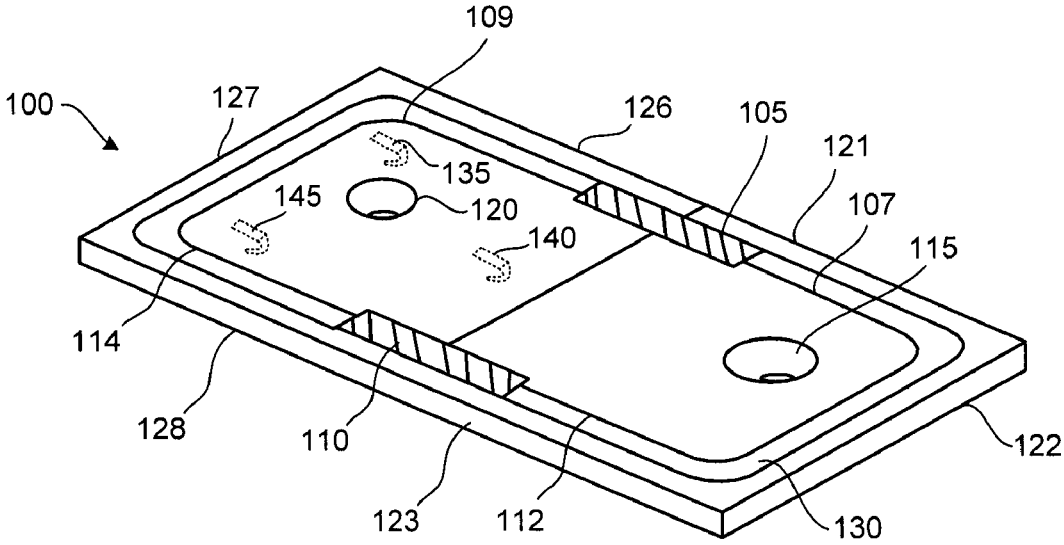
FIG. 6 illustrates a top perspective view of the embodiment of the convertible pillow of FIG. 5 having a translucent first surface portion revealing a plurality of food surface holding means.

As shown in the top perspective view of FIG. 6, the first surface portion 120 is illustrated as translucent to reveal the plurality of food surface portion fasteners 135, 140, 145 that removably fasten first surface portion 120 of the two-piece food surface to the receiving member (not shown) of the first pillow portion 101. In the illustrated embodiment, a plurality of food surface portion fasteners 135, 140, 145 are used, however, a single food surface portion fastener may be used with the same effect.

Figure 7:
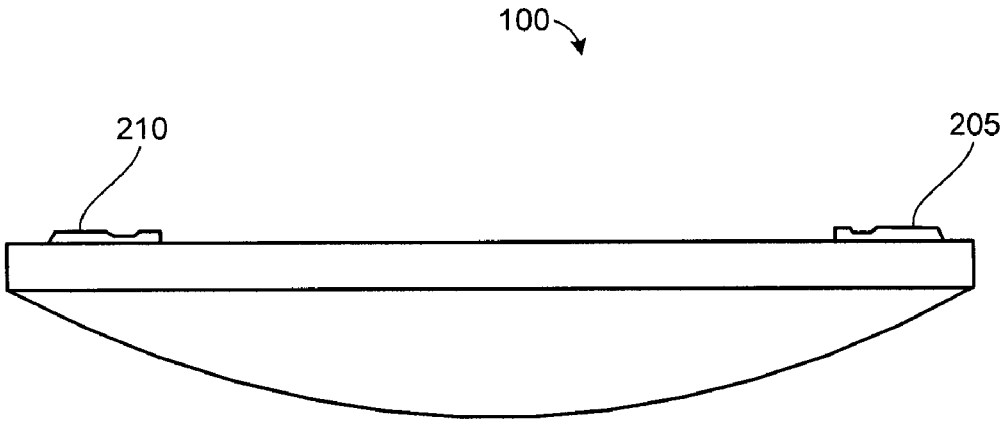
FIG. 7 illustrates an end view of one embodiment of a first pillow portion of a convertible pillow.
Figure 8:
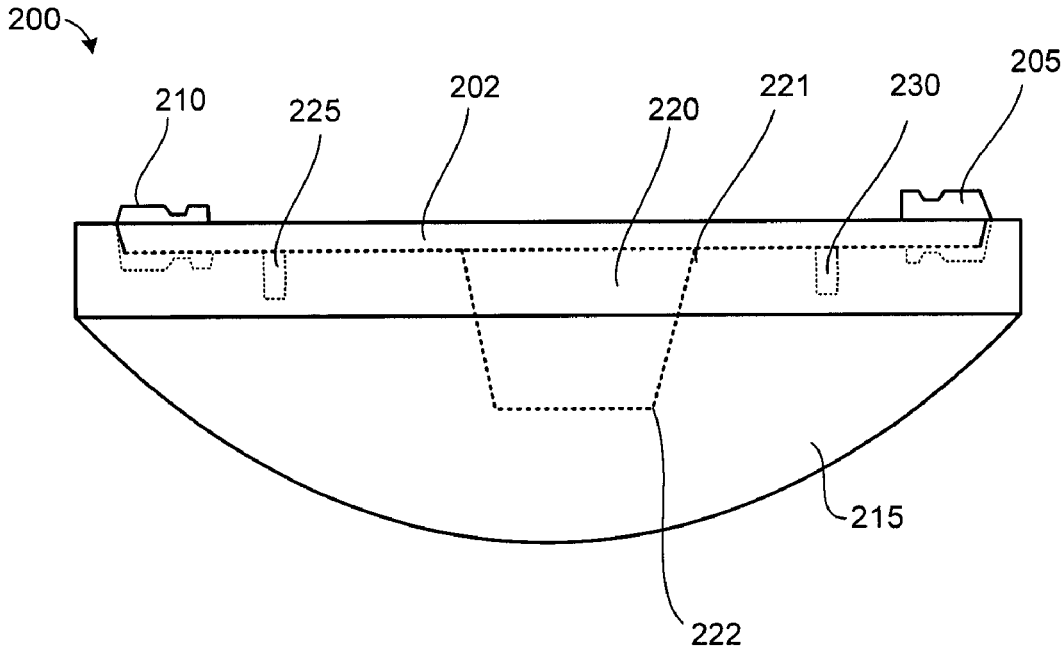
FIG. 8 illustrates a translucent first pillow portion of the convertible pillow in FIG. 7 revealing the location of a plurality of food surface holding means, a tapered cup holder and a plurality of slidable surface locking means.

FIGS. 7 and 8 illustrate an end view of one embodiment of a first pillow portion 215 of pillow 200 in an open position. In FIG. 7, the first slidable surface locking member 205 and second slidable surface locking member 210 are shown. As illustrated, the position and profile of each slidable locking member is such, that when the second pillow portion (not shown) is moved into the closed position, the pillow will close with little to no resistance from the two locking members. This creates a tighter seal at the coupling of the first and second pillow portions in the closed position. FIG. 8 is a translucent side view of the pillow portion 215 of pillow 200 to illustrate the approximate positioning and structure of the food surface 202 and the tapered cup holder 220 relative to the first slidable surface locking member 205 and second slidable surface locking member 210. As illustrated, the diameter of the opening in the food surface 202 at the top 221 of tapered beverage holder 220 is greater than the diameter of the tapered beverage holder 220 at the bottom 222. The configuration of the taper of the beverage holder 220 creates a stable receptacle for multiple sized beverage containers so as to prevent spillage. In the illustrated embodiment, the food surface 202 is removable and is secured in place to the pillow portion 215 by a plurality of surface holding hooks 225, 230.

Figure 9:
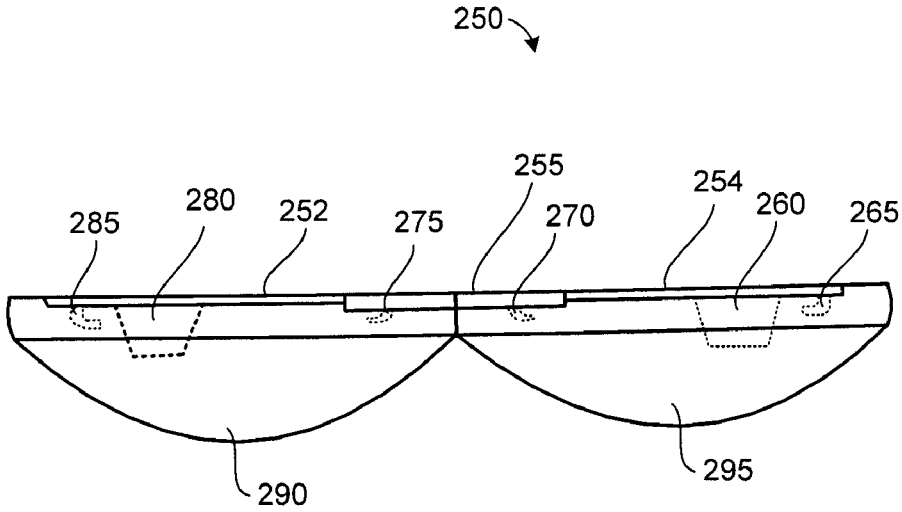
FIG. 9 illustrates a side view of one embodiment of a convertible pillow in the open position having a translucent first pillow portion and a translucent second pillow portion revealing the location of a plurality of food surface holding means, a tapered cup holder and a slidable surface locking mechanism.
Figure 10:
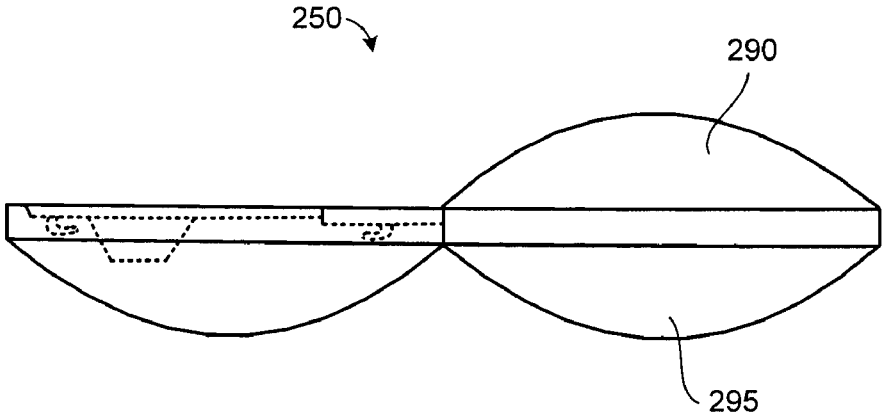
FIG. 10 illustrates a side view of one embodiment of a convertible pillow in the closed position having a translucent first pillow portion shown in the open position revealing the location of a plurality of food surface holding means, a tapered cup holder and a slidable surface locking mechanism interior to the first pillow portion.

A pillow 250 is illustrated in the open position and the closed position in FIGS. 9 and 10 respectively. In FIG. 9, the convertible pillow 250 is shown from a side view in the open position and pillow portions 290, 295 are translucent to illustrate the approximate location and construction of the food surface 252, 254 with the integral beverage holders 260, 280 as well as slidable locking mechanism 255. In the illustrated embodiment, food surface 252, 254 is a two-piece construction having a first food surface portion 252 and a second food surface portion 254. The first food surface portion 252 is configured to be coupled to the first pillow portion 290 and has an opening (not shown) to receive the tapered beverage holder 280. Typically, the first food surface portion 252 is removable for cleaning and is secured to the first pillow portion 290 using a number of food surface fasteners 275, 285. The second food surface portion 254 is configured to be coupled to the second pillow portion 290 and has an opening (not shown) to receive the tapered beverage holder 260. Typically, the second food surface portion 254 is also removable for cleaning and is secured to the first pillow portion 290 using a number of food surface fasteners 265, 270. In the open position, the two food surface portions 252, 254 are secured together at the coupling point 257 of the first pillow portion 290 and the second pillow portion 295 to create a single substantially coplanar surface using surface locking mechanism 255.

As shown in FIG. 10, pillow 250 is illustrated as transitioning from the open position of FIG. 9 to the closed position. In the closed position, the connecting edges of the first and second pillow portions 290, 295 are coupled together to create a pillow seal and hide the two-piece food surface 252, 254 from view. A pillow securing means (not shown) maintains the coupling of the connecting edges of the pillow portions 290, 295 so that the convertible pillow 250 may be utilized as a pillow.

Figure 11:
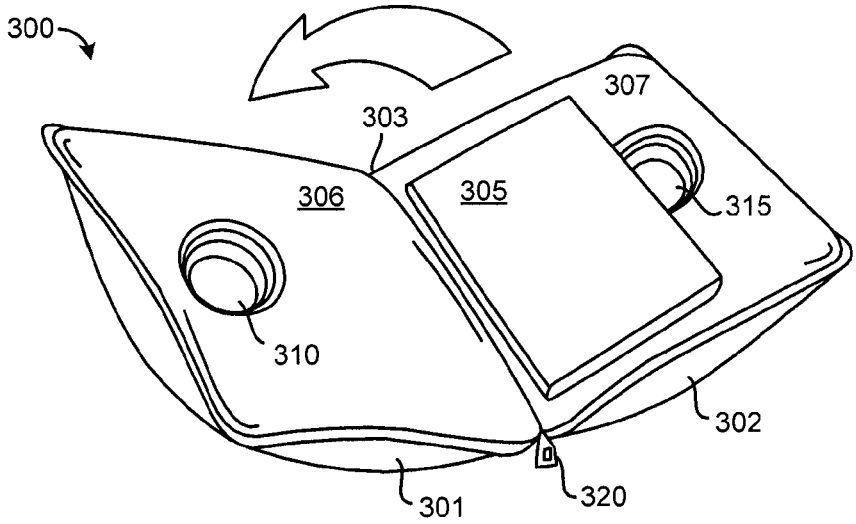
FIGS. 11-13 illustrate a top perspective view, top view and side view respectively of another embodiment of a convertible pillow having a plurality of concealed beverage holders and accompanying food surface.
Figure 12:
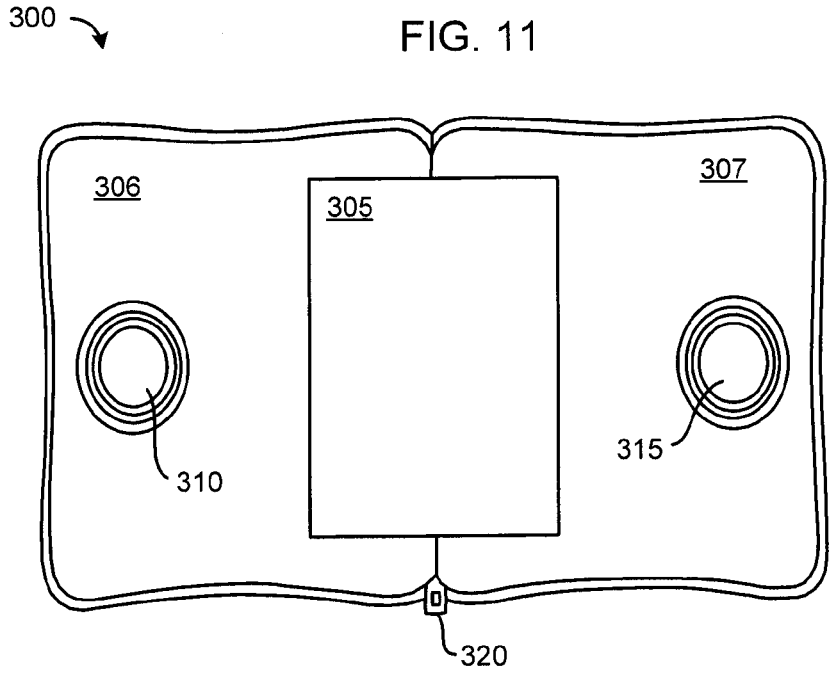
Figure 13:
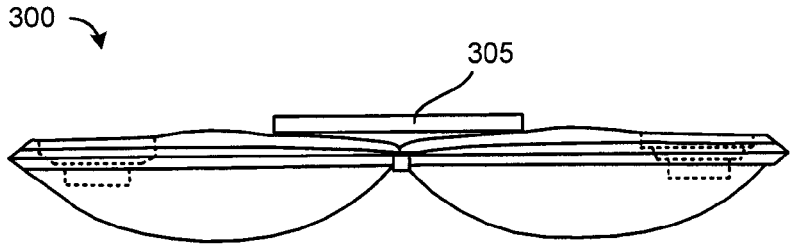

FIGS. 11-13 illustrate a top perspective, top and side view of another embodiment of convertible pillow 300 in the open position. In the illustrated embodiment, pillow 300 comprises a first pillow portion 301 and a second pillow portion 302 that are separate on three sides in the open position and coupled to one another along one edge at coupling point 303. The food surface 305 is again positioned within the interior of the pillow 300 so that it is not visible when the pillow is in the closed position, however, the food surface 305 may not be secured to either pillow portion 306, 307.

In operation, the food surface 305 rests on either or both the interior surface 306 of first pillow portion 301 and the interior surface 307 of second pillow portion 302. Food surface 305 may be secured to the interior surfaces 306, 307 using a Velcro strip attached to the back of the surface 305 or a similar securing means such that the surface does not slide around on the interior surfaces 306, 307. Instead of being integral with the food surface 305, beverage holder 310 is disposed within the first pillow portion 301 having an opening in interior surface 306 and beverage holder 315 is disposed within the second pillow portion 302 having an opening in interior surface 307. Pillow securing means 320 is used to secure the connecting edges of pillow portion 301 to the connecting edges of pillow portion 302 in the closed position (not shown).

Figure 14:
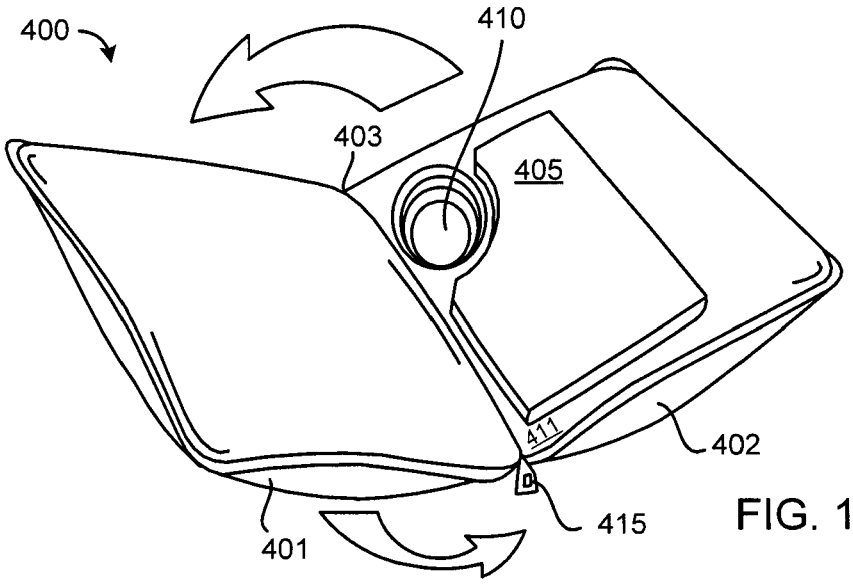
FIGS. 14-16 illustrate a top perspective view, top view and side view respectively of another embodiment of a convertible pillow having a single concealed beverage holder and accompanying food surface located in a first pillow portion.
Figure 15:
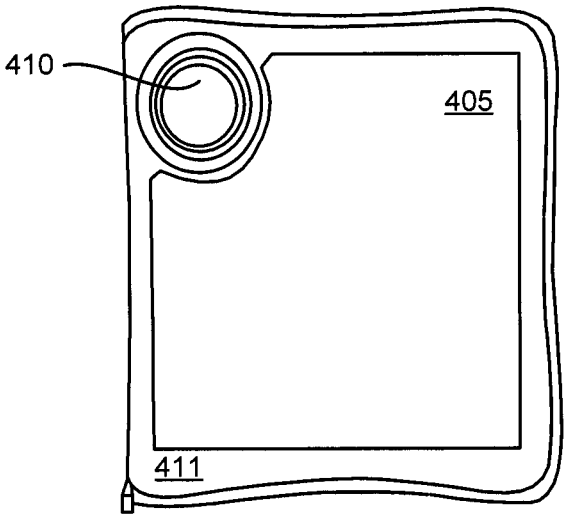
Figure 16:
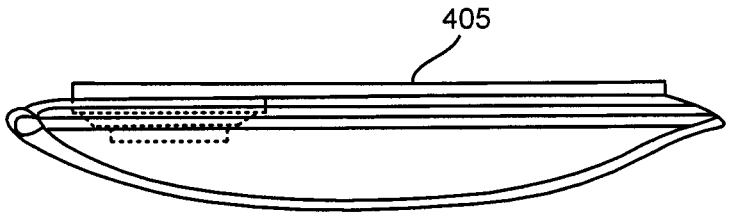

FIGS. 14-16 illustrate a top perspective, top and side view of another embodiment of convertible pillow 400 in the open position. In the illustrated embodiment, pillow 400 comprises a first pillow portion 401 and a second pillow portion 402 that are separate on three sides in the open position and coupled to one another along one edge at coupling point 403. As shown in FIG. 15, the second pillow portion 401 may be completely removed along the coupling point 403. The food surface 405 is again positioned within the interior of the pillow 400 and removably secured to the interior surface 411 of the second pillow portion 402 so that it is not visible when the pillow is in the closed position.

In operation, the food surface 405 is removably secured to the interior surface 411 of second pillow portion 402. Food surface 405 may be secured to the interior surface 402 using a Velcro strip attached to the back of the surface 405 or a similar securing means such that the surface does not slide around on the interior surface 411. Instead of being integral with the food surface 405, beverage holder 410 is disposed within the second pillow portion 402 having an opening in interior surface 411. Pillow securing means 420 is used to secure the connecting edges of pillow portion 401 to the connecting edges of pillow portion 402 in the closed position (not shown).

Figure 17:
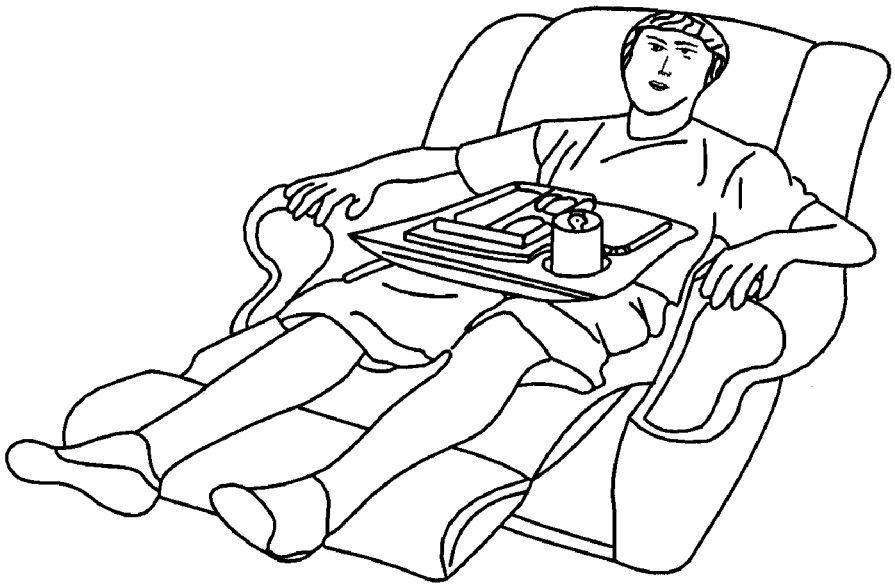
FIG. 17 illustrates the convertible pillow embodiment of FIGS. 14-16 in use.
Figure 18:
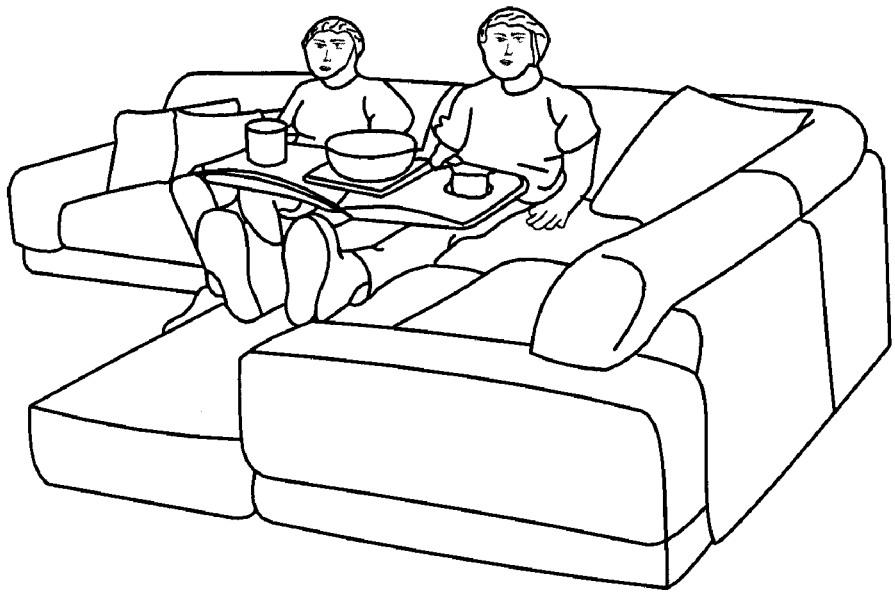
FIG. 18 illustrates any one of the convertible pillow embodiments of FIGS. 1-13 in operation.

FIGS. 17 and 18 illustrate embodiments of the convertible pillow illustrated and described with respect to FIGS. 1-16 in use. As shown, the user opens the convertible pillow from its closed position as a pillow to the open position as a food and beverage holder. In the open position, the pillow may be placed in any desirable location that provides the user with easy access to the food and/or drink.

Figure 19:
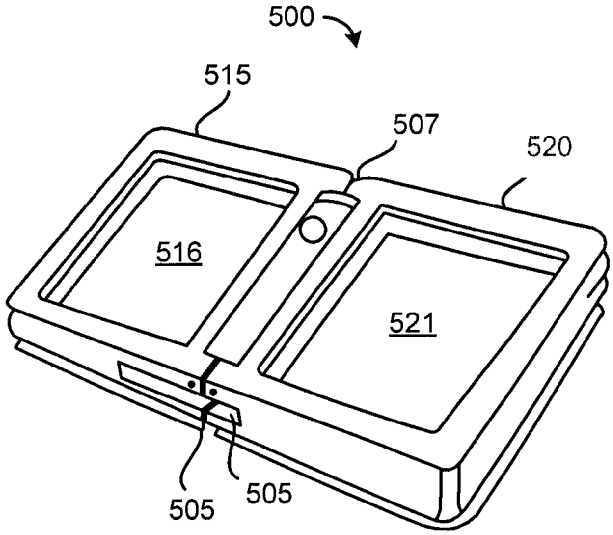
FIG. 19 illustrates a perspective view of one example of a modular base system.
Figure 20:
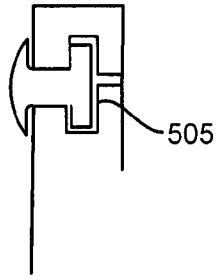
FIG. 20 illustrates one example of a locking mechanism for the modular base system of FIG. 19.
Figure 21:
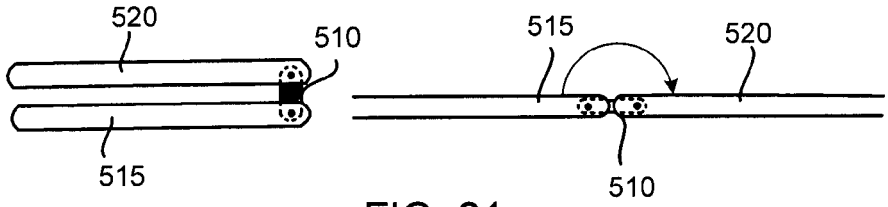
FIG. 21 illustrates the modular base system of FIG. 19 in the open and closed position.

FIGS. 19-21 illustrate one embodiment of a modular base system 500 having a first modular base portion 515 and a second modular base portion 520 that is configured to be inserted within a convertible pillow member (shown in FIG. 22) so as to create a convertible pillow system. As shown in FIG. 19, when the first and second modular base portions 515, 520 are in the open position, they may be locked into place by a locking mechanism 505. In one embodiment, locking mechanism 505 may be a T-slot or wedge shaped slide lock as illustrated in FIG. 20, however, one of ordinary skill in the art will appreciate that a similarly constructed locking device may be utilized without departing from the intended function of securing the first modular base portion 515 to the second modular base portion 520 so as to create a single structure. The first modular base portion 515 and the second modular base portion 520 are configured to receive a food surface or food storage bin (not illustrated) within openings 516, 521. In the illustrated embodiment, there is a small nesting lip, recessed within each modular base portion that is configured to receive the food surface or food storage bin (not illustrated).

Figure 22:
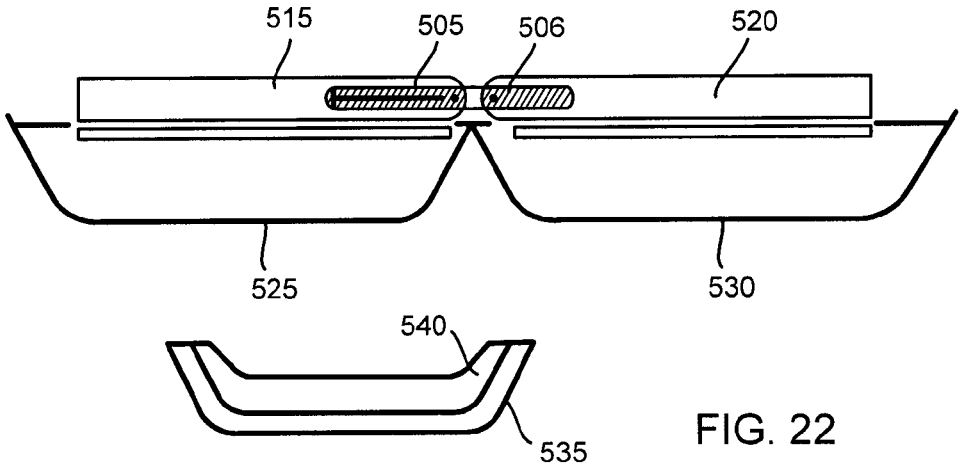
FIG. 22 illustrates a side view of the modular base system of FIG. 19 inserted within a convertible pillow.

In the open position, first modular base portion 515 can pivot relative to the second modular base portion 520, such that the first pillow portion can rotate relative to the second pillow portion when the convertible pillow is opened and closed (illustrated in FIG. 22). In the locked position, first modular base portion 515 is fixed relative to the second modular base portion 520 by sliding the slide lock mechanism 505 from a first position to a second position within the lock slot 506, where a portion of the slide lock 505 is positioned over the fold line 507. In the locked position, slide lock 505 prevents the first modular base portion 515 from pivoting relative to the second modular base portion 520.

FIG. 21 illustrates one example of a hinging system 510 such that the first modular base portion 515 can open and close relative to the second modular base portion 520 when the modular base portion 500 is inserted within a convertible pillow member. As shown in FIGS. 21 and 22, hinging system is illustrated as a hinge that allows first modular base portion 515 to pivot relative to the second modular base portion 520 so as to move between an open position and a closed position when the first pillow portion 525 is moved from the closed position to the open position and back to the closed position relative to the second pillow portion 530 in the convertible pillow system. In the illustrated embodiment, first and second pillow portions 525, 530 are constructed of a two-piece design having a semi rigid foam cushion 540 and batting material 535. However, the pillow portions may be constructed of any suitable material for forming a pillow, without departing from the scope and spirit of the invention.

Figure 23:
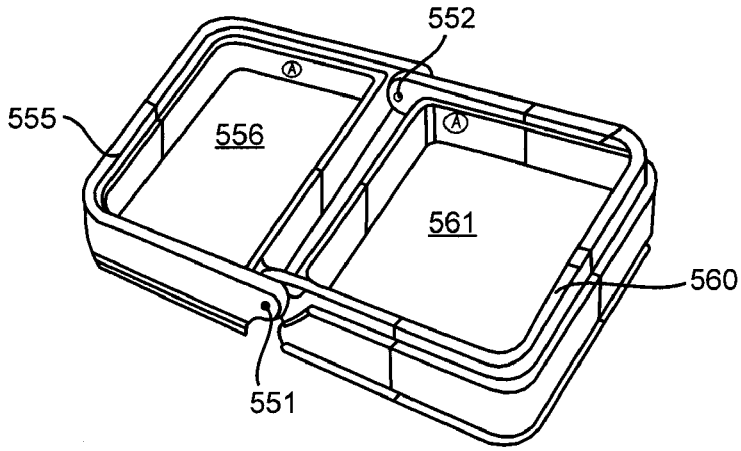
FIG. 23 illustrates a perspective view of another example of a modular base system.
Figure 24:
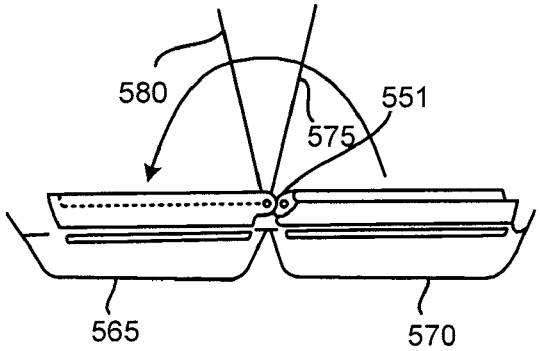
FIG. 24 illustrates a side view of the modular base system of FIG. 23 inserted within a convertible pillow.

FIGS. 23 and 24 illustrate another embodiment of a modular base system frame 550 having a first modular base portion 555 and a second modular base portion 560 that pivot on a first hinge 551 and a second hinge 552 that are coaxial or share the same axis of rotation. The first modular base portion 555 and the second modular base portion 560 are configured to receive a food surface or food storage bin (not illustrated) within openings 556, 561. In the illustrated embodiment of FIGS. 23 and 24, there is a small nesting lip, recessed within each modular base portion that is configured to receive the food surfaces 575, 580 shown in FIG. 24 and/or a food storage bin (not illustrated).

Figure 25:
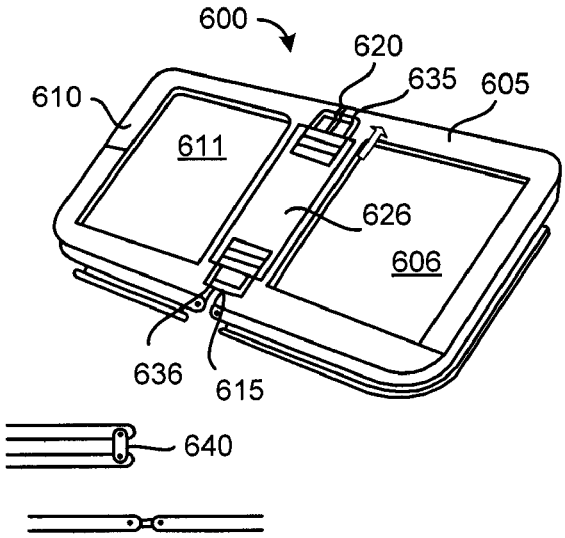
FIG. 25 illustrates a perspective view of one example of a modular base system.
Figure 26:
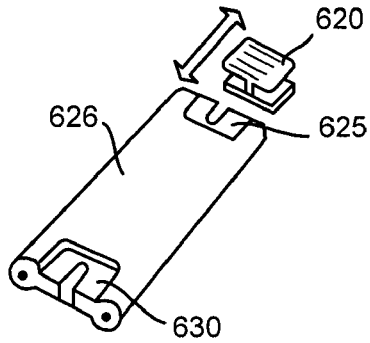
FIG. 26 illustrates one example of a locking mechanism for the modular base system of FIG. 25.

FIGS. 25 and 26 illustrate another embodiment of a modular base system frame 600 having a first modular base portion 605 and a second modular base portion 610. As shown in FIG. 25, when the first and second modular base portions 605, 610 are in the open position (i.e., the first and second pillow portions of the convertible pillow system are in the open position), they may be locked into place by a first and second slide lock mechanism 615, 620. In the illustrated embodiment, slide lock mechanisms 615, 620 are each slid from the recesses 625, 630 in center portion 626 to the recesses 635, 636 within the first and second modular base portions 605, 610, however, one of ordinary skill in the art will appreciate that a similarly constructed locking device may be utilized without departing from the intended function of securing the first modular base portion 605 to the second modular base portion 610 so as to create a single rigid structure. The first modular base portion 605 and the second modular base portion 610 are configured to receive a food surface or food storage bin (not illustrated) within openings 606, 611.

In the open position, first modular base portion 605 can pivot relative to the second modular base portion 610, such that the first pillow portion can rotate relative to the second pillow portion when the convertible pillow is opened and closed (illustrated in FIG. 22). In the locked position, first modular base portion 605 is fixed relative to the second modular base portion 610 by slide lock mechanisms 615, 620 moving from a first position to a second position within the lock slots 635, 636, where a portion of the slide lock 615, 620 is positioned over the fold line 631. In the locked position, slide locks 615, 620 prevent the first modular base portion 605 from pivoting relative to the second modular base portion 610.

FIG. 25 illustrates another example of a center link hinging system 640 such that the first modular base portion 605 can open and close relative to the second modular base portion 610 when the modular base portion 600 is inserted within a convertible pillow member. As shown in FIG. 25, hinging system is illustrated as a hinge that allows first modular base portion 605 to pivot relative to the second modular base portion 610 so as to move between an open position and a closed position when the first pillow portion is moved from the closed position to the open position and back to the closed position relative to the second pillow portion in the convertible pillow system.

Figure 27:
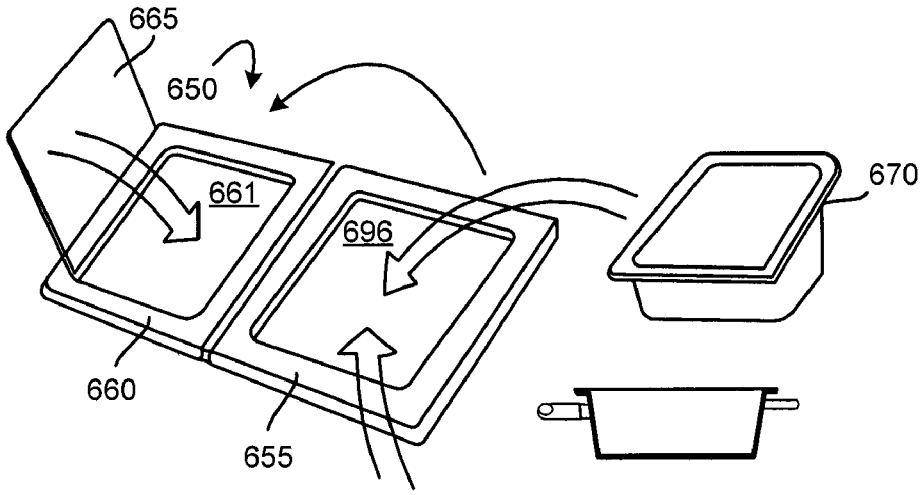
FIG. 27 illustrates a perspective view of one example of a modular base system.

FIG. 27 illustrates another embodiment of a modular base system frame 650 having a first modular base portion 655 and a second modular base portion 660. The first modular base portion 655 and the second modular base portion 660 are configured to receive a food surface 665 or food storage bin 670 within openings 656, 661. Any combination of storage bins/food surfaces may be utilized in a given design.

Figure 28:
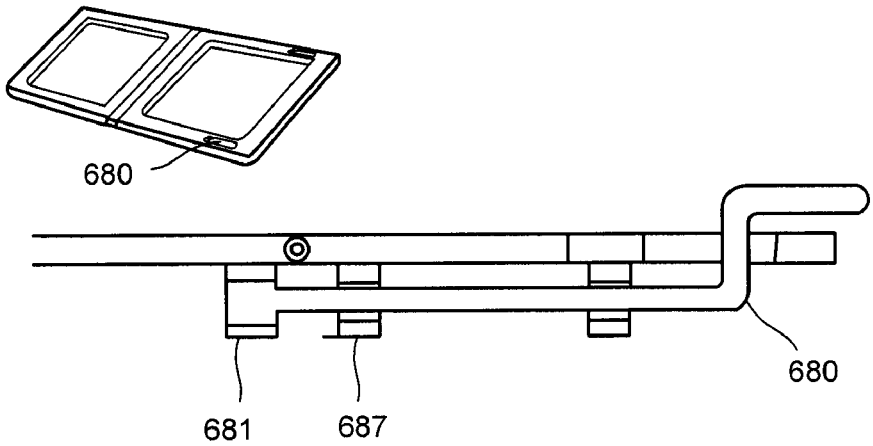
FIG. 28 illustrates one example of a locking mechanism for the modular base system of FIG. 27.
Figure 29:
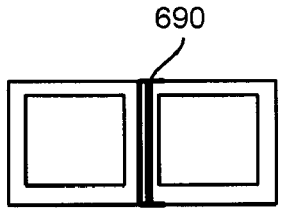
FIG. 29 illustrates another example of a locking mechanism for the modular base system of FIG. 27.

As shown in FIGS. 28 and 29, when the first and second modular base portions 655, 660 are in the open position (i.e., the first and second pillow portions of the convertible pillow system are in the open position), they may be locked into place by a slide lever lock 680 or a slide bar lock 690. As illustrated in FIG. 28, in the open position, and to secure the first modular base portion to the second modular base portion, the slide lever lock 680 is moved from a first position to a second position such that the slide lever lock is within the first lever lock retainer 681 on the second modular base portion and the first lever lock retainer 682 on the first modular base portion. The position of the slide lever lock 680 within the first and second lever lock retainer 681, 682 prevents the first modular base portion from rotating with respect to the second modular base portion. The sliding bar lock 690 illustrated in FIG. 29 performs a similar function. In the illustrated embodiment, sliding lock lever 690 is attached to the edges of the first and second modular base portions and is configured to slide from one to the other. In the locked position (i.e., the convertible pillow is in the open position), the sliding lock lever is positioned over the fold line 691 such that the first modular base portion is prevented from pivoting relative to the second modular base portion.

Figure 30:
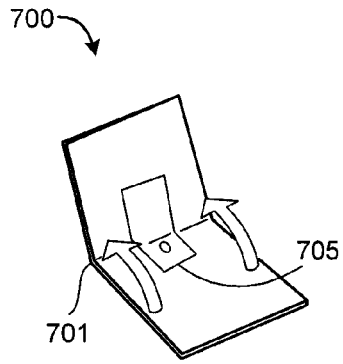
FIG. 30 illustrates a perspective view of one example of a locking mechanism for a tray surface.
Figure 31:
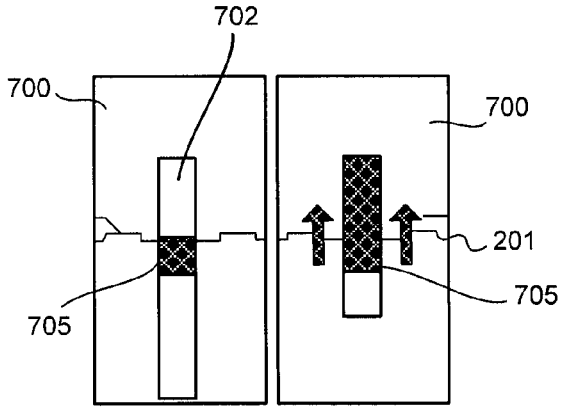
FIG. 31 illustrates a top view of the slidable food surface lock member for the tray surface of FIG. 30.
Figure 32:
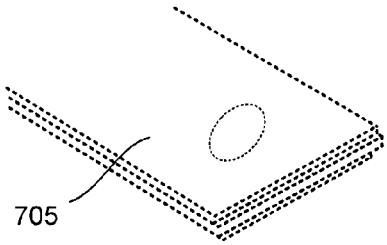
FIG. 32 illustrates a close-up of the slidable food surface lock member of FIG. 30.

FIGS. 30-32 illustrate one example of a food surface locking mechanism in accordance with one aspect of the present invention. The first food surface portion pivots relative to the second food surface portion at the fold line 701. In the unlocked position, the slidable food surface lock member 705 is not covering the fold line 701. In the unlocked position, the first food surface portion pivots freely relative to the second food surface portion of the food surface 700. In the locked position, a portion of the slidable lock member is moved into the lock groove on the first food surface portion and therefore positioned over the fold line 701. The slidable food surface lock member 705 prevents the first food surface from pivoting relative to the second food surface and therefore creates a single rigid food surface 700.

Figure 34:
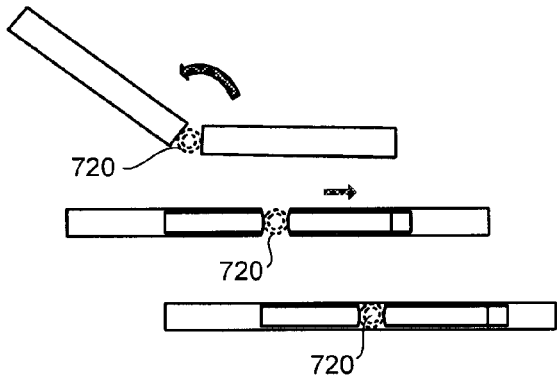
FIG. 34 illustrates a side view of the independent hinge locking mechanism of FIG. 33.
Figure 33:
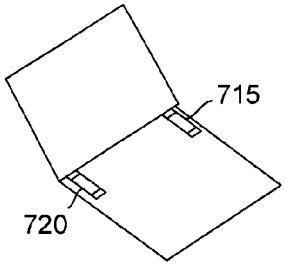
FIG. 33 illustrates a perspective view of another example of a locking mechanism for a tray surface.
Figure 36:
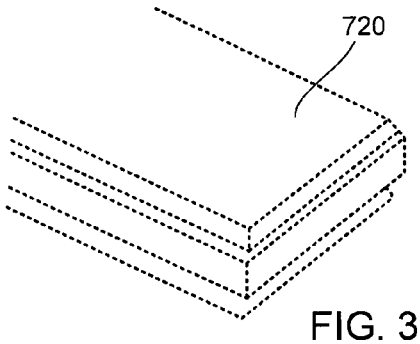
FIG. 36 illustrates a close-up of the independent hinge locking mechanism of FIG. 33.
Figure 35:
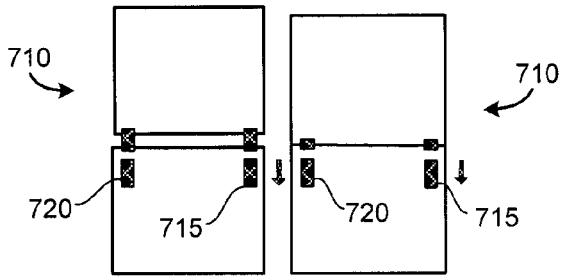
FIG. 35 illustrates a top view of the independent hinge locking mechanism for the tray surface.

FIGS. 33-36 illustrate another example of a food surface locking mechanism in accordance with another aspect of the present invention. The first food surface portion pivots relative to the second food surface portion at the fold line 711 at an independent hinge 720. As shown in FIGS. 34 and 35, in the unlocked position, the independent hinge 720 is allowed to pivot freely and thus the first food surface portion may pivot freely relative to second food surface portion. In the open or locked position, a portion of the independent hinge 720 is slid within the second surface portion of the food surface member 710 thereby locking the first food surface relative to the second food surface. In the locked position, the independent hinge 720 prevents the first food surface from pivoting relative to the second food surface and therefore creates a single rigid food surface 710.

Figure 37:
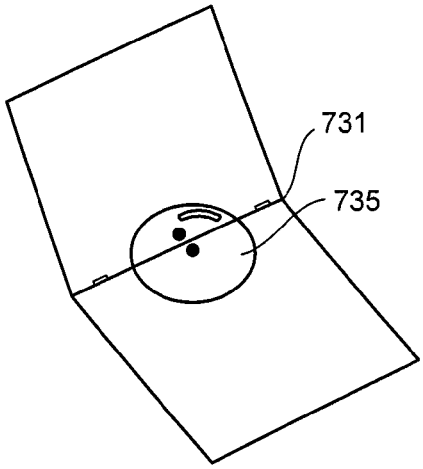
FIG. 37 illustrates a perspective view of another example of a locking mechanism for the tray surface.
Figure 38:
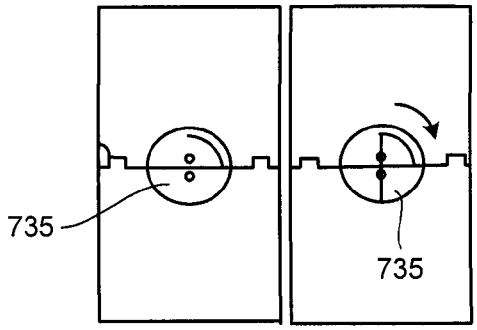
FIG. 38 illustrates a top view of the rotating locking disk mechanism for the tray surface of FIG. 37.
Figure 40:
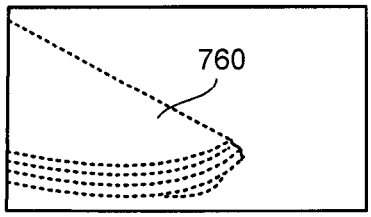
FIG. 40 illustrates a close-up of the rotating locking disk mechanism of FIG. 37.
Figure 39:
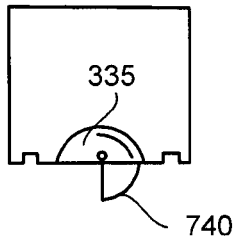
FIG. 39 illustrates a cut-away top view of the rotating locking disk mechanism for the tray surface of FIG. 37

FIGS. 37-40 illustrate yet another example of a food surface locking mechanism in accordance with another aspect of the present invention. The first food surface portion pivots relative to the second food surface portion at the fold line 731. As shown in FIG. 37, in the unlocked position, the hinges are allowed to pivot freely and thus the first food surface portion may pivot freely relative to second food surface portion. In the open or locked position, as shown in FIGS. 38 and 39, rotating locking disk 735 rotates in a clockwise direction and a disk portion 740 is slid within the second surface portion of the food surface member 730 thereby locking the first food surface relative to the second food surface. In the locked position, the extruded edges of disk portion 740 of the rotating locking disk 735 (as shown in FIG. 40) prevents the first food surface from pivoting relative to the second food surface and therefore creates a single rigid food surface 730.

Figure 41:
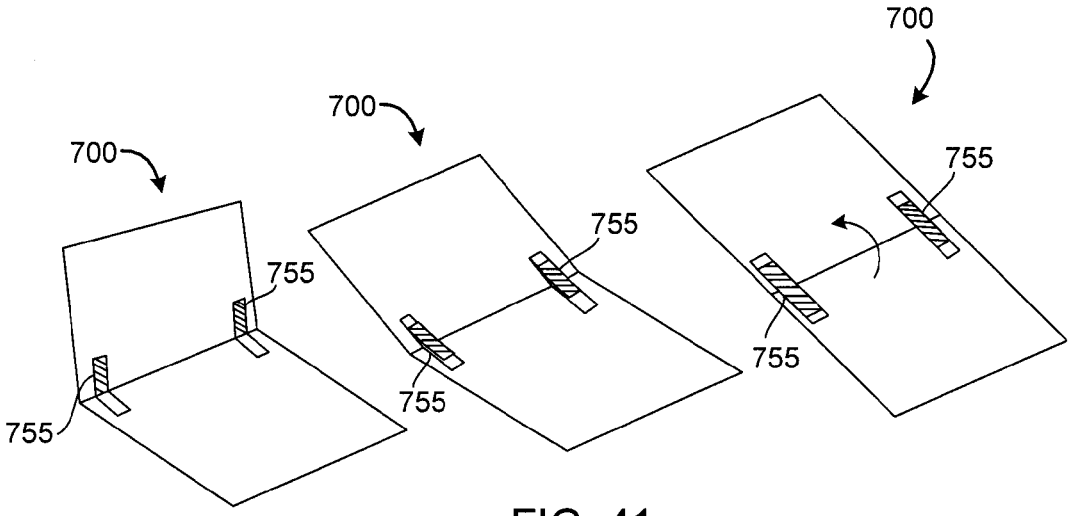
FIG. 41 illustrates a perspective view of another example of a locking mechanism for the tray surface.
Figure 42:
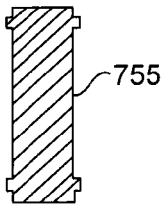
FIG. 42 illustrates a top view of the sliding hinge mechanism of FIG. 41.
Figure 43:
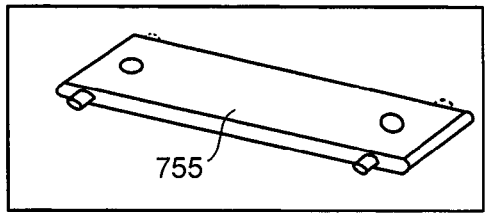
FIG. 43 illustrates a perspective view of the sliding hinge mechanism of FIG. 41.

FIGS. 41-43 illustrate still another example of a food surface locking mechanism in accordance with another aspect of the present invention. The first food surface portion pivots relative to the second food surface portion at the fold line 751 using a first sliding hinge 755 and a second sliding hinge 760. As shown in FIG. 41, in the unlocked position, the first sliding hinge 755 and the second sliding hinge 760 are allowed to slide freely within its respective pivot channel and thus the first food surface portion may pivot freely relative to second food surface portion. Such movement allows the first pillow portion to move relative to the second pillow portion in a convertible pillow system. In the open or locked position, the first and second sliding hinges 755, 760 straddle the fold line 751 and, as shown in the illustrated embodiment of the FIGS. 42 and 43, utilize a number of button locks to hold the sliding hinge in place, thereby locking the first food surface relative to the second food surface. In the locked position, the first and second sliding locks 755, 760 prevents the first food surface from pivoting relative to the second food surface and therefore creates a single rigid food surface 750.

Figure 44:
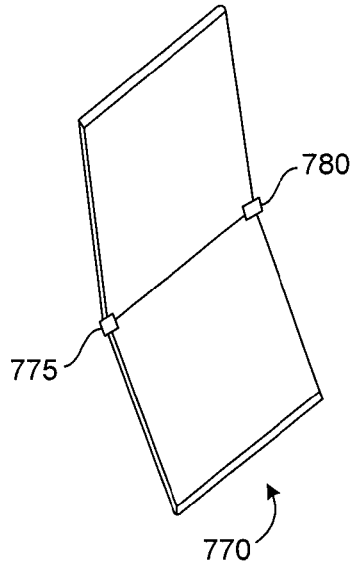
FIG. 44 illustrates a perspective view of another example of a locking mechanism for the tray surface.
Figure 45:
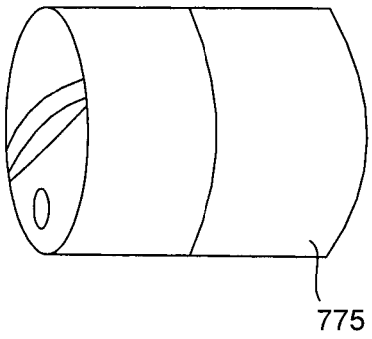
FIG. 45 illustrates a front view of the push pin locking mechanism of FIG. 44.
Figure 46:
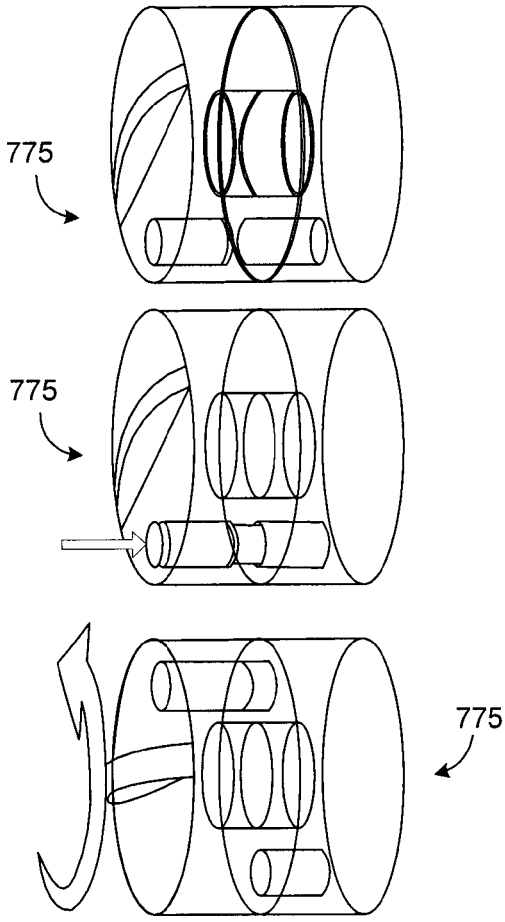
FIG. 46 illustrates a cut-away view of the push pin locking mechanism of FIG. 44.

FIGS. 44-46 illustrate still another example of a food surface locking mechanism in accordance with another aspect of the present invention. The first food surface portion pivots relative to the second food surface portion at the fold line 771 using a first push pin locking hinge 775 and a second push pin locking hinge 780. As shown in FIG. 46, in the unlocked position, a button of the first push pin locking hinge 775 is pushed to disengage the pin member and therefore allow a first part of the push pin locking hinge to rotate relative to a second part of the push pin locking hinge, and thus the first food surface portion may pivot freely relative to second food surface portion. In the open or locked position, as shown in FIGS. 45 and 46, the first and second push pin locking hinges 775, 780 match up the push pins of the first and second push pin locking hinges such that the first part will not rotate relative to the second part of either push pin locking hinge, thereby locking the first food surface relative to the second food surface. In the locked position, the first and second push pin locking hinges 775, 780 prevents the first food surface from pivoting relative to the second food surface and therefore creates a single rigid food surface 750.

Figure 47:
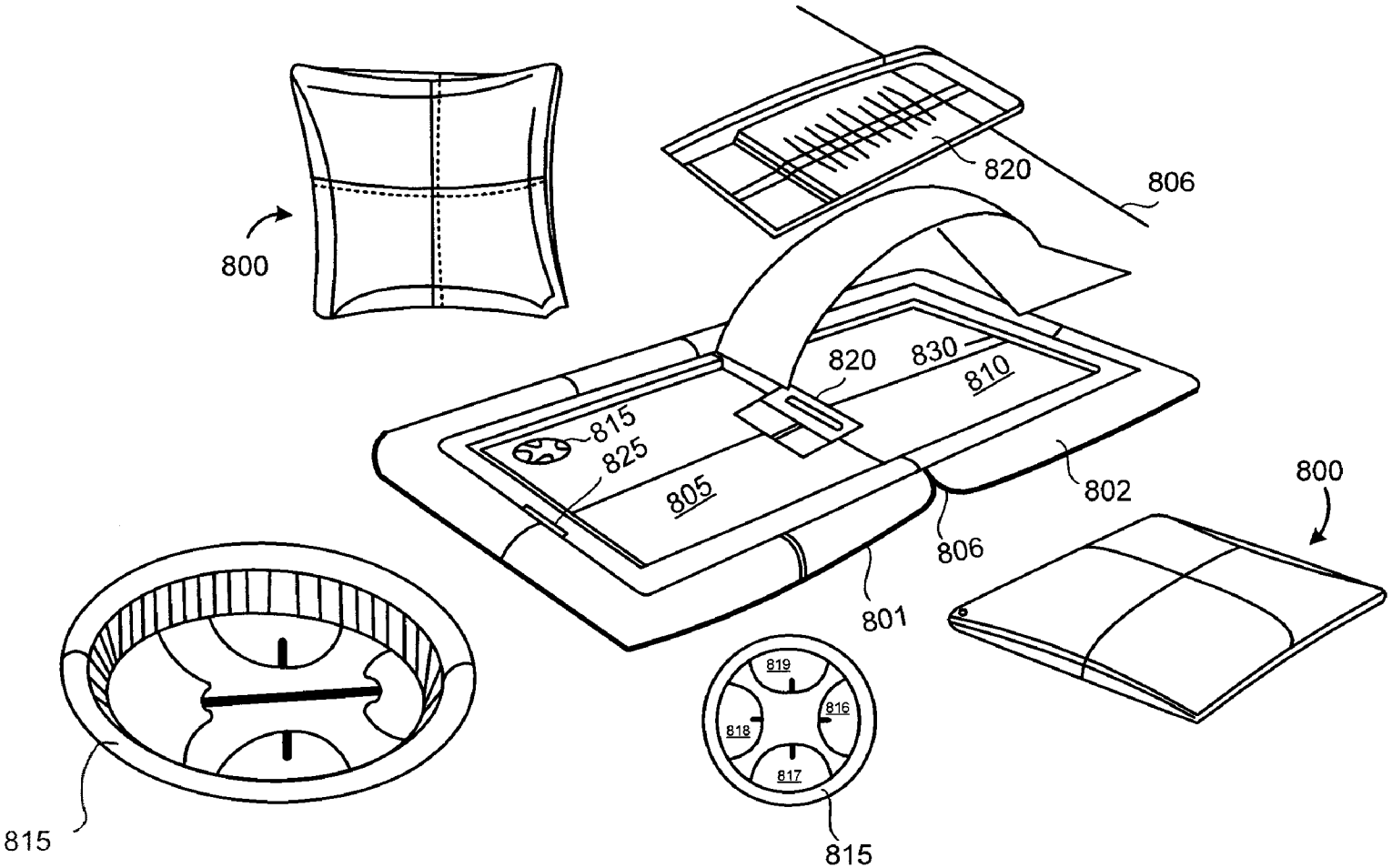
FIG. 47 illustrates another embodiment of a convertible pillow having a concealed beverage holder and accompanying food surface.

FIG. 47 illustrates another example of a convertible pillow 800. Convertible pillow 800 is comprised of a first pillow portion 801 and a second pillow portion 802, coupled on a single side and separable on three sides in the open position. In the illustrated embodiment, the first pillow portion 801 is configured to be hinged and foldable relative to said second pillow portion 802 at the coupled edges so as to convert between said closed position and said open position, both illustrated in FIG. 47. In the open position, the first surface portion 805 and the second surface portion 810 are exposed to the environment and may be used as a surface. In the illustrated embodiment, in the locked position, a sliding lock member 820 prevents the first surface portion 805 from moving relative to the second surface portion 810, thereby creating a rigid, single surface. Sliding lock member 820 slides within a lock channel and a portion of the sliding lock member covers the folding joint 806, thus preventing the first surface portion 805 in the first pillow portion 801 from rotating relative to the second surface portion 810 in the second pillow portion 802 in the open position of the convertible pillow 800.

A single cupholder is shown in the first surface portion 805. As one of skill in the art can appreciate, any number of cup holders may be utilized in accordance with the present invention. The cupholder 815 has a number of flaps 816, 817, 818, 819 that holds various sized drink containers. In the illustrated embodiment, a magnetic system having a first magnet fastener 825 and second magnet fastener 830 couples the first pillow portion 801 to the second pillow portion 802 in the closed position. Any number of closing means may be used to secure the first pillow portion to the second portion, such as a zipper, velcro, latch, or lock, to name a few.

Figure 48:
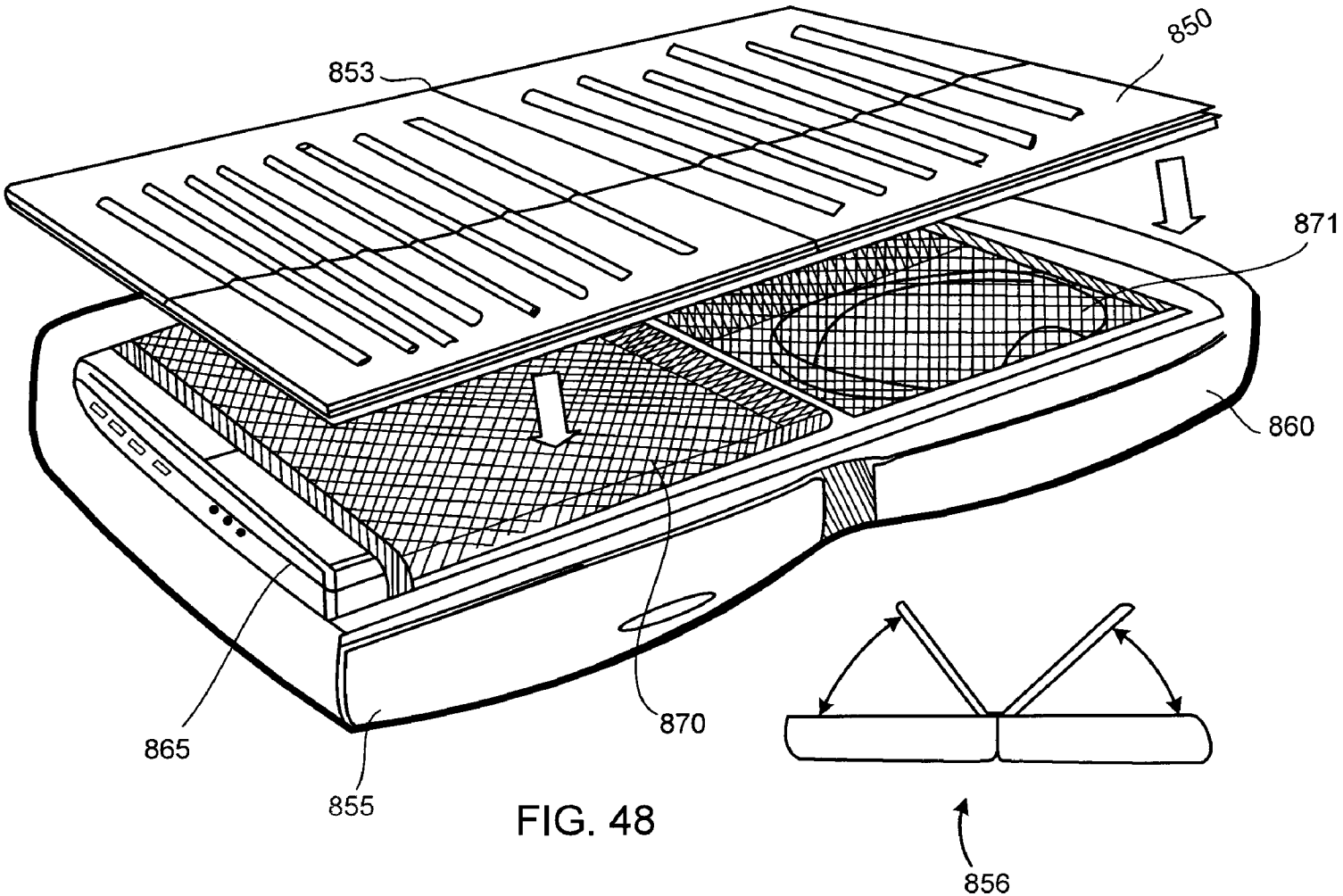
FIG. 48 illustrates an embodiment of a convertible pillow having storage bins and a tray surface.

FIG. 48 illustrates an alternative embodiment of a convertible pillow 856, where the convertible pillow has a first pillow portion 855 and a second pillow portion 860, including a combination of storage bins 870, 871 and surface member 850. The storage bins 870, 871 are configured to hold a laptop 865 and any accessories. The surface member 850 comprises a first surface member portion 851 and a second surface member portion 852 and is configured to fold along fold line 853 such that it may fold with the opening and closing of the convertible pillow 856.

Figure 49:
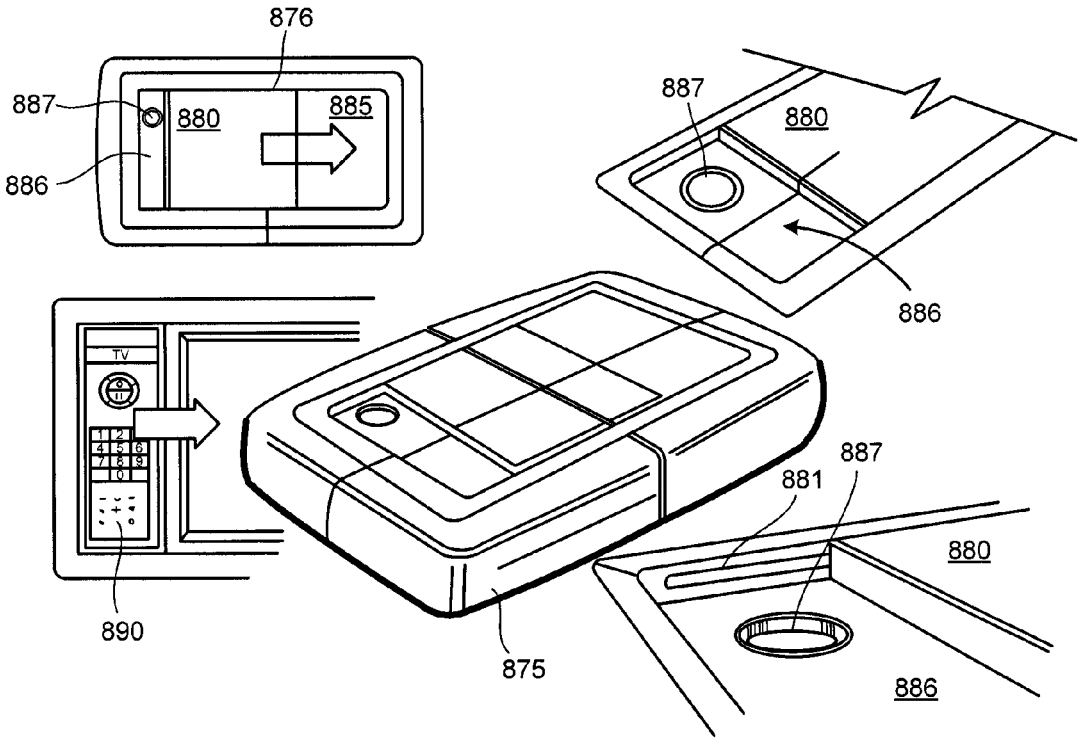
FIG. 49 illustrates an embodiment of a convertible pillow a tray surface that locks the pillow in the open position with a hidden area for a beverage holder or universal remote.

The illustrated convertible pillow 875 of FIG. 49 shows another locking means to keep the pillow from folding over during use. In the illustrated embodiment, the tray surface having a first tray surface member 880 and a second tray surface member 885 locks the convertible pillow in the open position. When opening and closing the convertible pillow 875, the fold line between the first tray surface member 880 and the second tray surface member 885 matches the fold line 876 of the pillow 875. In the open or locked position, the first tray surface member 880 and the second tray surface member 885 are moved within the channel 881 so that a portion of the second tray surface member 885 covers the fold line 876 of the pillow 875 and prevents the pillow from closing. As shown in the illustrated embodiment, a cupholder 887 and surface 886 or a universal remote 890 may be exposed for use when the between the first tray surface member 880 and the second tray surface member 885 are in the locked or open position.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as the invention.

What is claimed is:

1. A convertible pillow having a closed position as a pillow and an open position as a food surface and beverage holder, said convertible pillow comprising:

a pillow member having a first pillow portion and a second pillow portion, an edge of said first pillow portion coupled to an edge of said second pillow portion, corresponding edges of said first and second pillow portions are separable on three sides in the open position and said corresponding edges of said first and second pillow portions are securable on three sides in the closed position, said first pillow portion configured to be hinged and foldable relative to said second pillow portion at the coupled edges so as to convert between said closed position and said open position; and a food surface member having at least one beverage holder disposed therein, said food surface member sized to be enclosed within said pillow member in said closed position, said beverage holder being configured to securely receive different sizes of beverage containers.

2. The convertible pillow of claim 1, wherein said food surface member is removably secured to at least one of said first pillow portion and said second pillow portion using at least one food surface member holding means.

3. The convertible pillow of claim 1, wherein said food surface member comprises a two-piece food surface member having a first surface portion and a second surface portion, wherein said first surface portion is removably secured to said first pillow portion using at least one food surface member holding means and said second surface portion is removably secured to said second pillow portion using at least one food surface member holding means.

4. The convertible pillow of claim 3, wherein said first food surface member and said second food surface member are removably secured together by at least one slidable surface locking member.

5. The convertible pillow of claim 1, wherein said first food surface member and said second food surface member each comprise a non-skid textured surface.

6. The convertible pillow of claim 1, wherein said at least one beverage holder is tapered from its maximum diameter at an opening in the food surface member.

7. The convertible pillow of claim 1, wherein said first pillow portion is adapted to be coupled to said second pillow portion in said closed position by a pillow fastening mechanism.

8. The convertible pillow of claim 7, wherein said pillow fastening mechanism is a zipper.

9. The convertible pillow of claim 1, wherein said first and second pillow portions comprise a memory foam.

10. The convertible pillow of claim 1, wherein said first and second pillow portions are covered with a removable fabric covering.

11. A convertible pillow having a closed position as a pillow and an open position as a food surface and beverage holder, said convertible pillow comprising:

a pillow member having a first pillow portion edge configured to be hinged relative to a second pillow portion edge to convert between a closed position and an open position, said first pillow portion is removably coupled to said second pillow portion at three corresponding edges so as to convert between said closed position and said open position; and a food surface member having at least one beverage holder disposed therein, said food surface member sized to be enclosed within the interior of said pillow member in said closed position, said at least one beverage holder being tapered from its maximum diameter at an opening in the food surface member.

12. The convertible pillow of claim 11, wherein said food surface member is removably affixed to at least one of said first pillow portion and said second pillow portion using at least one food surface member hooks.

13. The convertible pillow of claim 11, wherein said food surface member comprises a two-piece food surface member having a first surface portion and a second surface portion, wherein said first surface portion is removably affixed to said first pillow portion using at least one food surface member hook and said second surface portion is removably affixed to said second pillow portion using at least one food surface member hook.

14. The convertible pillow of claim 13, wherein said first food surface member and said second food surface member are removably secured together by at least one slidable locking member, wherein said at least one slidable locking member slides within a slidable locking member groove located on at least one surface of said first and second food surface members and positioned adjacent an edge of said first and second food surface members.

15. The convertible pillow of claim 11, wherein said first pillow portion is adapted to be coupled to said second pillow portion in said closed position by a pillow fastening mechanism.

16. The convertible pillow of claim 11, wherein said first and second pillow portions are covered with a removable fabric covering.

17. A method of using a convertible pillow having a closed position as a pillow and an open position as a food surface and beverage holder, said method comprising:

providing said convertible pillow having, a pillow member having a first pillow portion and a second pillow portion, said first pillow portion is configured to be removably coupled to said second pillow portion so as to convert between said closed position and said open position;

a food surface member having at least one beverage holder disposed therein, said food surface member sized to be enclosed within said convertible pillow in said closed position, said at least one beverage holder being tapered from its maximum diameter at an opening in the food surface member; and opening said convertible pillow from said closed position to said open position.

18. The method of claim 17, further comprising:

providing a food surface member having a 2-piece food surface member comprising a first surface portion and a second surface portion, wherein said first surface portion is removably affixed to said first pillow portion and said second surface portion is removably affixed to said second pillow portion; and removably securing said first food surface member and said second food surface member together as a coplanar surface by at least one slidable locking member.

19. The method of claim 18, further comprising coupling said first pillow portion to said second pillow portion in said closed position by a pillow fastening mechanism.

20. A convertible pillow comprising:

a pillow member having a first pillow portion and a second pillow portion, said first pillow portion being configured to be coupled to said second pillow portion in a closed position, said first pillow portion configured to be uncoupled from said second pillow portion along at least three pillow portion edges in an open position;

a two-piece food surface having a first surface portion and a second surface portion, said two-piece food surface configured to be enclosed within the interior of said pillow member in said closed position, said first and second surface portions each having a tapered beverage holder located within an opening in said surface portions, said first and second surface portions each having a first slidable tray lock groove positioned adjacent an edge of said surface portions; and a first slidable tray lock configured to move between a first position and a second position within said first slidable tray lock grooves in said first surface portion and said second surface portion, said first position is configured to allow said first pillow portion and said second pillow portion to be coupled in said closed position, said second position configured to allow said first surface portion and said second surface portion to be secured together as a substantially flat coplanar surface when said first and second pillow portions are uncoupled in said open position.

21. The convertible pillow of claim 20, wherein said first surface portion is removably secured to said first pillow portion and said second surface portion is removably secured to said second pillow portion.

22. The convertible pillow of claim 21, wherein said first surface portion is removably secured to said first pillow portion using at least one surface portion fastener and said second surface portion is removably secured to said second pillow portion using at least one surface portion fastener.

23. The convertible pillow of claim 21, further comprising:

a second slidable tray lock groove positioned adjacent an edge of each of said first and second surface portions; and a second slidable tray lock configured to move between a first position and a second position within said second slidable tray lock grooves in said first surface portion and said second surface portion, said first position is configured to allow said first pillow portion and said second pillow portion to be coupled in said closed position, said second position configured to allow said first surface portion and said second surface portion to be secured together as a substantially flat coplanar surface when said first and second pillow portions are uncoupled in said open position.

* * * * *